US005390521A

United States Patent [19]

Kerze

[11] Patent Number: 5,390,521

[45] Date of Patent: Feb. 21, 1995

[54] RIDGE ROLLER DEVICE

[76] Inventor: Joseph E. Kerze, 17446 Hatteras St., Encino, Calif. 91316

[21] Appl. No.: 101,568

[22] Filed: Aug. 3, 1993

[51] Int. Cl.[6] ..... B21D 19/04

[52] U.S. Cl. ..... 72/122; 72/126; 72/211

[58] Field of Search ..... 72/74, 117, 120, 122, 72/126, 211

[56] References Cited

U.S. PATENT DOCUMENTS

| | | | |
|---|---|---|---|
| 644,932 | 3/1900 | Miller . | |
| 909,182 | 1/1909 | Hart . | |
| 2,618,184 | 11/1952 | Goedhart | 81/3.6 |
| 2,905,226 | 9/1959 | Knorr | 153/79 |
| 2,956,459 | 10/1960 | Brookhouse | 81/15 |
| 3,426,565 | 2/1969 | Schott | 72/122 |
| 4,087,997 | 5/1978 | Steenhoek | 72/122 |
| 4,474,046 | 10/1984 | Cook | 72/409 |
| 4,602,496 | 7/1986 | Wagener | 72/409 |

FOREIGN PATENT DOCUMENTS

| | | | |
|---|---|---|---|
| 129656 | 1/1929 | Switzerland | 72/211 |

*Primary Examiner*—Lowell A. Larson
*Attorney, Agent, or Firm*—Sanford Astor

[57] ABSTRACT

A hand operated tool used to remove the burr from the inside end of a cut metal pipe comprising two rollers adapted to be placed inside the end of a pipe, means to expand the rollers with a hand squeezing motion on the handles of the tool and rotating the pipe or tool until the burr is rolled outward making the inside of the pipe free of any obstructions.

7 Claims, 8 Drawing Sheets

FIG. 1
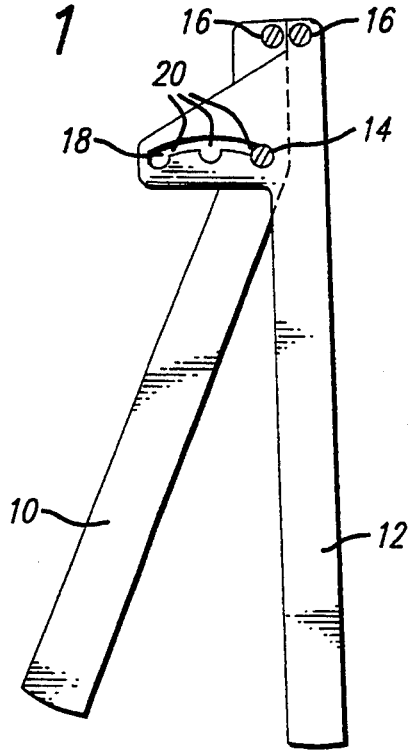
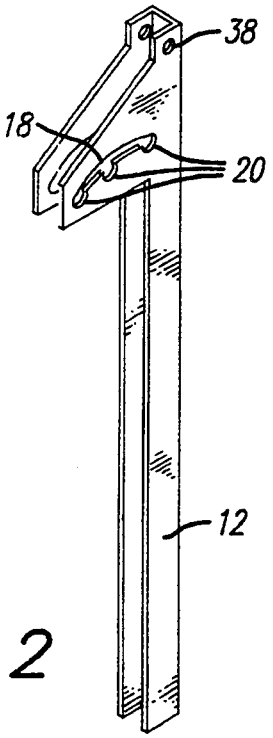
FIG. 2
FIG. 3
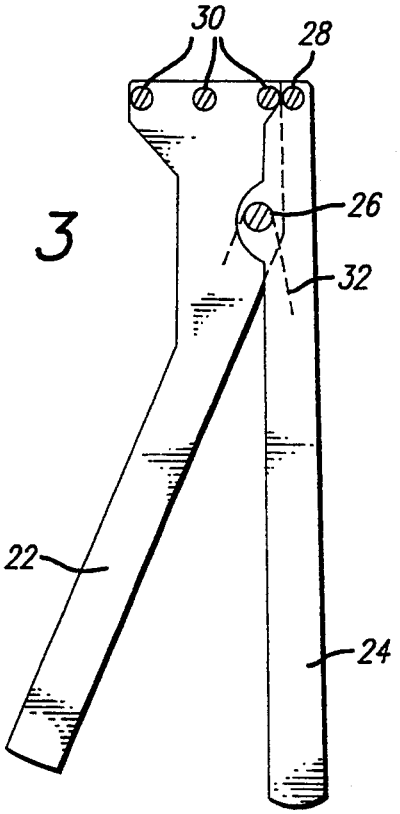
FIG. 4
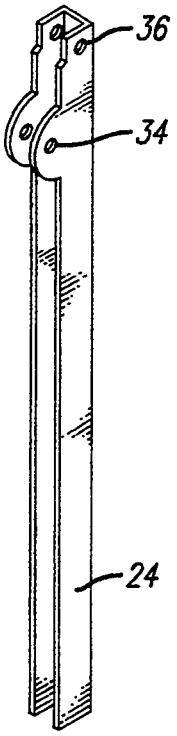

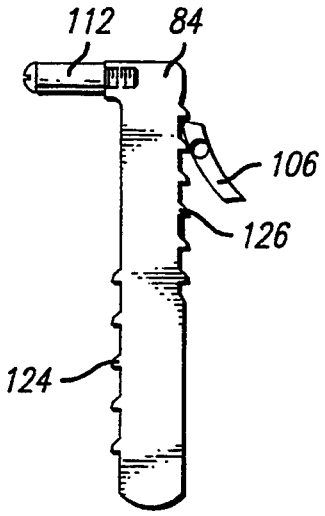
FIG. 18c
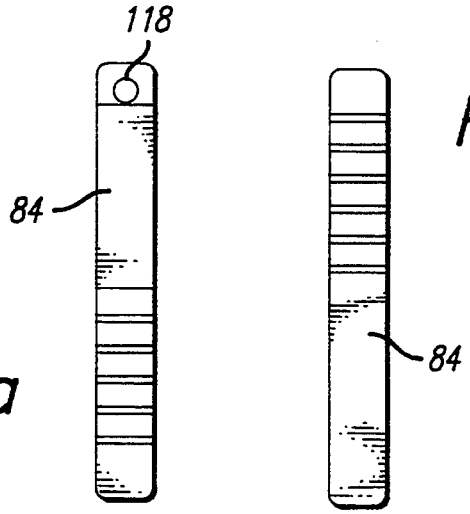
FIG. 18b
FIG. 18a
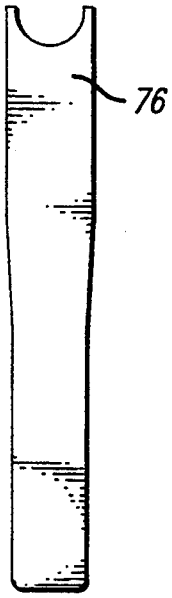
FIG. 19b
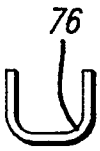
FIG. 19a

RIDGE ROLLER DEVICE

BACKGROUND OF THE INVENTION

In the installation of pipes used for plumbing such as copper, a tubing cutter is most often used to cut the pipe to length. A cutting wheel is forced with pressure into the surface of the pipe with a rolling motion until it cuts through.

This rolling or cutting motion leaves a ridge or burr on the inside circumference of the pipe. This burr, if left intact, can cause several different problems in the pipe system such as noise, restricting the flow of water, causing turbulence inside a fitting that will erode the pipe and fitting with friction or creating a place for minerals to collect and then break off in larger chunks that cause related problems in water valves.

Existing tools that are specifically designed to remove this ridge or burr include blades, knives and reamers that cut the burr out, producing sharp tiny metal slivers. These metal slivers may inadvertently make their way into a potable water system and be expelled through a faucet or shower at a later time and be ingested or embedded in a person having contact with the water. Also it is not uncommon for the metal slivers to cause a mechanical failure in a water valve such as a faucet.

Existing burr removing tools can be dangerous, difficult and time consuming to operate and the blades get dull from use and have to be replaced often to retain their degree of safety and efficiency.

The tool of this invention leaves the burr intact by reversing the rolling force that caused the ridge in the first place by rolling the burr or ridge back out with an internal, outwardly extending rolling force.

OBJECTS OF THE INVENTION

With this background in mind, it is an object of this invention to create a hand-held, hand-operated tool specially designed to remove the ridge or burr from the inside circumference of a cut pipe.

Another object is to create a deburring tool that is safer to operate by being void of sharp edges.

Still a further object is to make available a tool that will improve the overall safety of the water system by eliminating the possibility of tiny sharp metal slivers from being introduced into the system.

Yet another object of this invention is to make available a tool that is easier, faster and more professional to use than conventional deburring tools thus increasing the likelihood of the pipe being installed correctly.

DESCRIPTION OF THE INVENTION

With the foregoing and other objects in mind, the invention comprises a hand-held, hand-operated tool for the removal of the burr or inside ridge from the inside circumference of a cut pipe most often used, hut not limited to, plumbing. The tool of invention comprises two handles normally between 2" and 14" in length pivotally connected together within the top $\frac{1}{3}$ of their entire length with smooth rollers usually between $\frac{1}{4}$" and 3" long and up to about than 1" in diameter, attached opposite the pivot in such a way to allow their independent movement away from each other, in order to exert outward pressure.

The rollers are inserted inside the end of a cut pipe and expanded while the pipe and tool are rotated in relationship to each other. Each roller pushes outward on the burr, rolling it outwardly until the roller contacts the inside diameter of the pipe thus, eliminating the obstructive burr or ridge from the inside circumference surface of the pipe.

Since the contact area of the rollers and burr is so small the hand force needed to operate the tool is limited. As the burr is rolled out, the contact area of the rollers is increased to it's entire length and a significant difference is felt in the energy needed to operate the tool. This difference signals the completion of the deburring action.

When the bottom portion of the lever handles are squeezed together within the palm and fingers of the hand, the pivot or connecting axle becomes the transfer point of energy to expand the parallel rollers away from each other and the two compressed handles act as a single handle to rotate the smooth rollers inside the pipe end.

BRIEF DESCRIPTION OF THE DRAWING

FIG. 1 is a front view of one embodiment of the tool of the invention.

FIG. 2 is a perspective view of one of the handles of the tool of FIG. 1.

FIG. 3 is a front view of another embodiment of the tool.

FIG. 4 is a perspective view of one handle thereof.

FIG. 18 *a,b* & *c* are front, back and side views of the rack gear of FIG. 17.

FIG. 19 *a* & *b* are the rear and top views of one handle of FIG. 13 and FIG. 17.

DETAILED DESCRIPTION OF THE INVENTION

Figure 5:
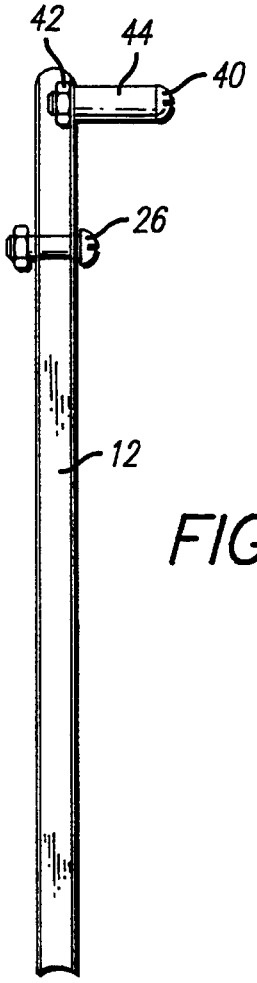
FIG. 5 is a side view of one handle of FIG. 1.
Figure 6:
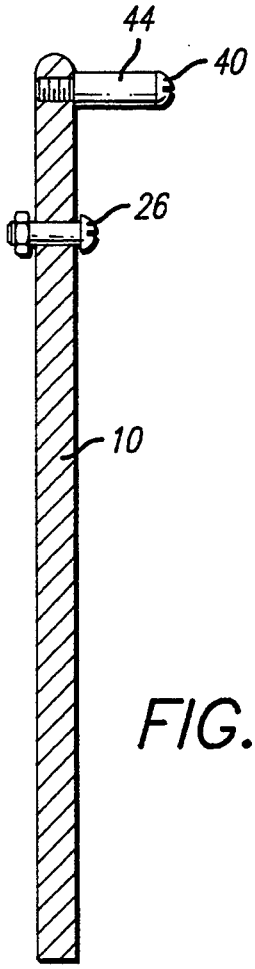
FIG. 6 is a side view of the other handle of FIG. 1.
Figure 7:
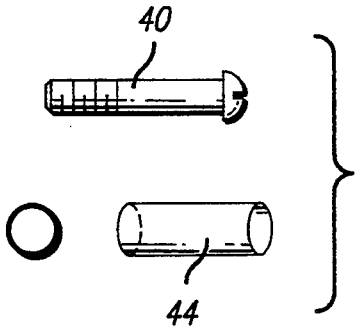
FIG. 7 is a side elevation of the roller assembly.

All five embodiments of the invention depicted in FIG. 1–21 inclusive show a pipe deburring tool that comprises a first lever handle and a second lever handle, the handles connected with an axle screw, and having a plurality of rollers affixed thereto.

FIGS. 1 and 2 depict an embodiment in which handles 10 and 12 pivot around a pivot point having a connecting axle 14. Each handle 10 & 12 has a roller 16 attached to the top end thereof. Rollers 16 are fixed in position. The tool is adjustable by means of a channel 18 with multiple notches 20 sized to fit the connecting axle 14 of the opposing lever handle 10 to form a tool that is adjustable to deburr different diameters of pipes.

FIGS. 3 and 4 depict an embodiment in which handles 22 and 24 pivot around a pivot point having a connecting axle 26. A single roller 28 is attached to the top of lever handle 24 and a plurality of rollers 30 are attached to the top of handle 22, making the tool adjustable to deburr different diameters of pipes. A spring 32 biases handles 22 and 24 to the open position. The spring is present in each embodiment of the invention even if not shown. Handles 22 and 24 are sized and shaped to be operable between the palm and fingers of the hand.

In both embodiments described above, and as shown in more details in FIGS. 5,6 and 7 handles 12 and 24 are "U" shaped. Handle 24 has a single axle hole 34 whereas in handle 12 there are multiple axle holes 20. Holes 36 in handle 24 and holes 38 in handle 12 are for attachment of the roller screw 40 (held by nut 42) on which roller 44 freely rotates.

Handles 10 and 22 are solid pieces sized to fit into the "U" shaped opening of handles 12 and 24. It can be seen that when each pair of handles 10 and 12 or 22 and 24 are squeezed together the rollers 16 or 28 and 30 separate and move apart so that they can be pressed against the inside circumference of the pipe to be deburred.

Figure 10:
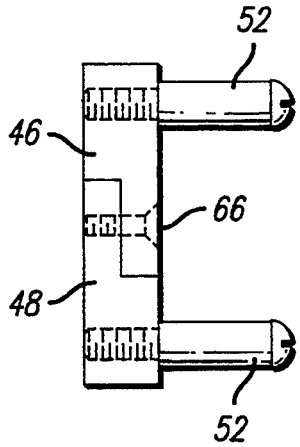
FIG. 10 is a top view of the embodiment of FIG. 8.
Figure 8:
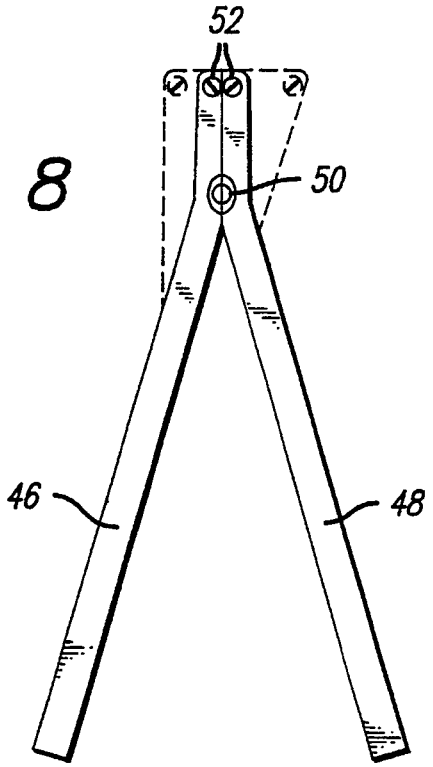
FIG. 8 is a front view of another embodiment.
Figure 9:
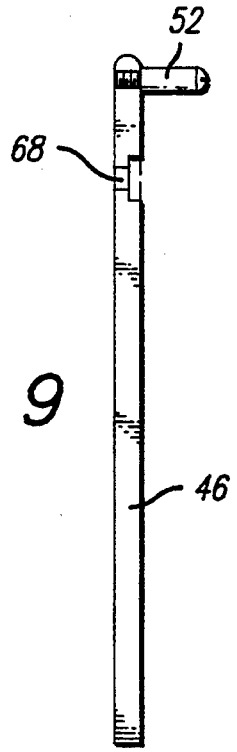
FIG. 9 is a side view of one of the handles of FIG. 8.
Figure 11:
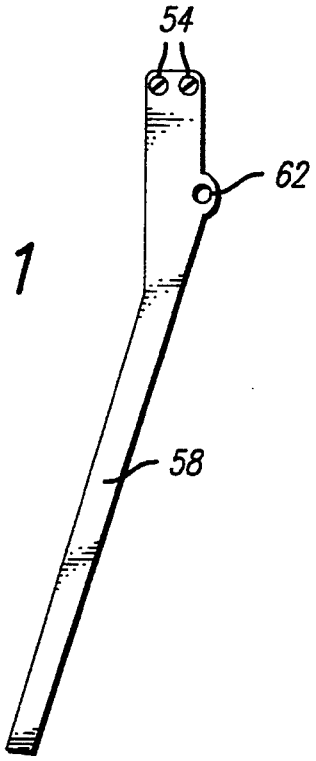
FIG. 11 is a front view of an alternate handle of FIG. 8.
Figure 12:
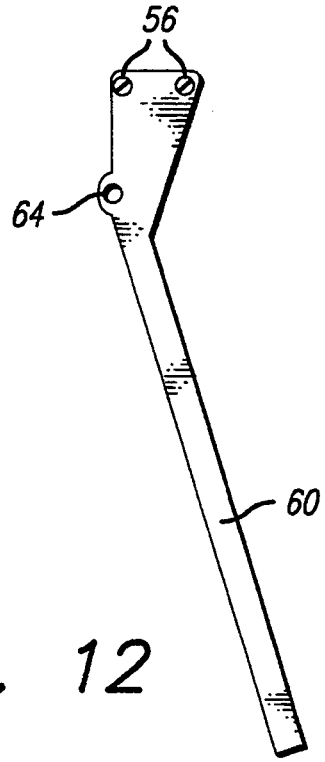
FIG. 12 is a front view of the other handle of FIG. 8.

FIGS. 8,9,10,11 and 12 depict another embodiment in which the handles 46 and 48 of the tool pivot about a fixed pivot point 50. Single rollers 52 are attached to the top of each handle 46 and 48. Multiple rollers 54 and 56 can be attached as shown in handles 58 and 60 which allows greater adjustment of the tool. FIG. 10 shows a top view of the tool with the rollers 52 in a separated position.

Handles 46, 48, 58 and 60 are all solid stock with a single axle hole such as 62 in one handle and a threaded axle hole such as 64 in the other handle, for overlapping connection by an axle screw such as 66. The handles have a reduced width 68 where they overlap to provide proper fit.

Figure 16A:
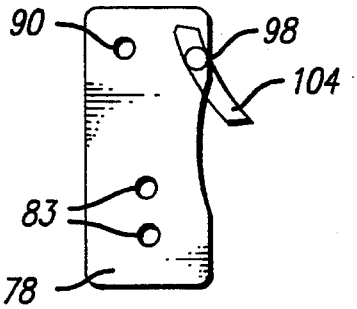
FIG. 16 *a* & *b* are side and top views of the rack gear housing of FIG. 13.
Figure 16B:
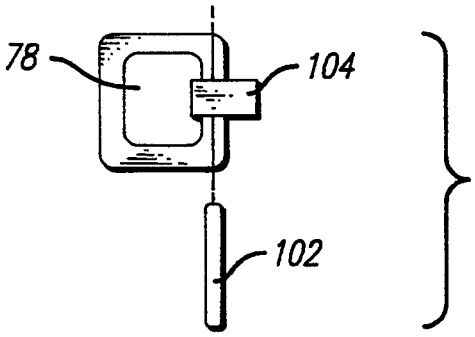
Figure 17:
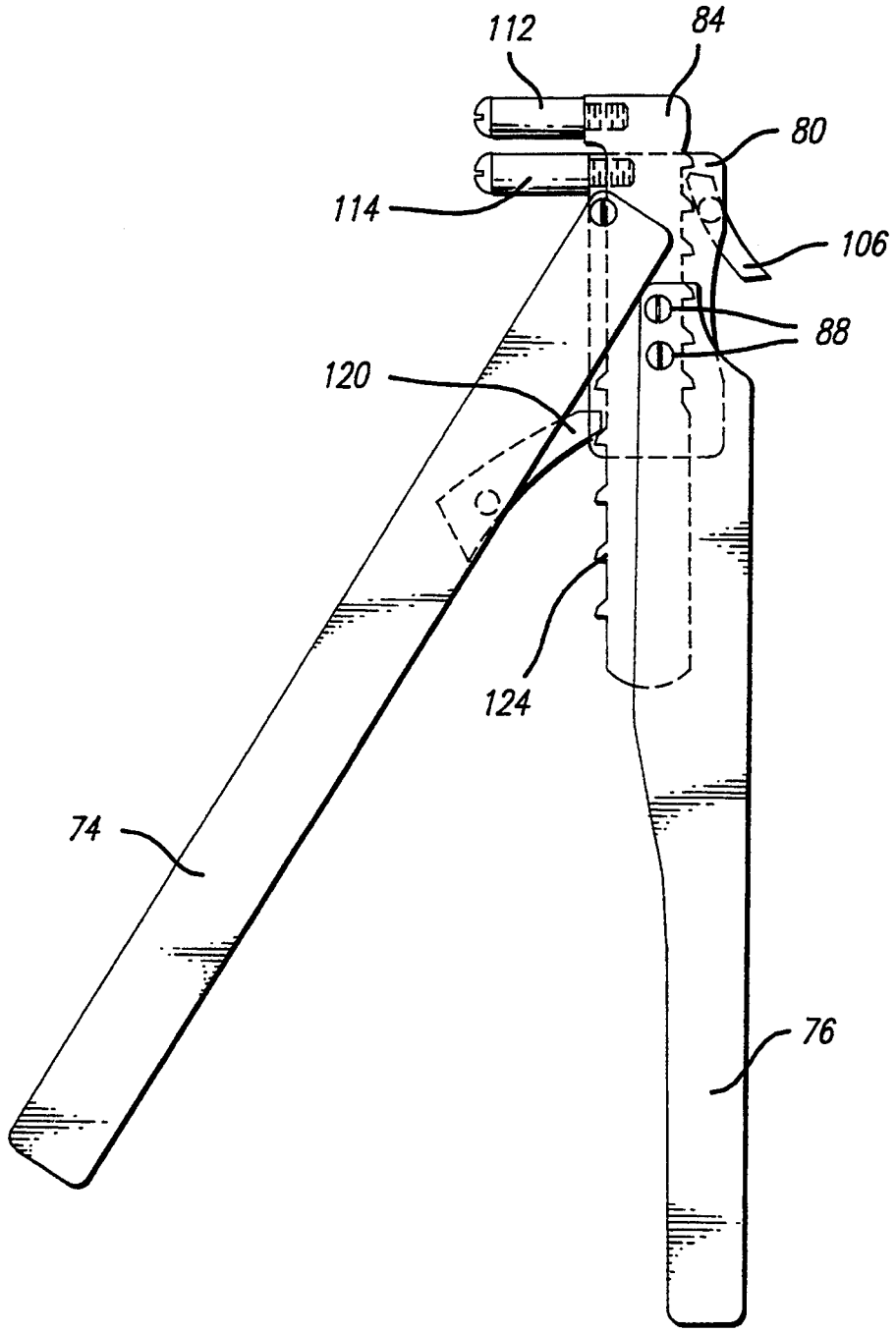
FIG. 17 is a front view of another embodiment.

Referring now to FIGS. 13 through 21, there is shown the pair of handles 70–72 (FIGS. 13) and 74–76 (FIG. 17). Handles 72 and 76 consist of a "U" shaped elongated handle of which FIG. 19*b* is a top view. Attached to handle 72 or 76 is a housing 78 or 80 through which passes an adjustable rack gear 82 or 84.

Figure 20A:
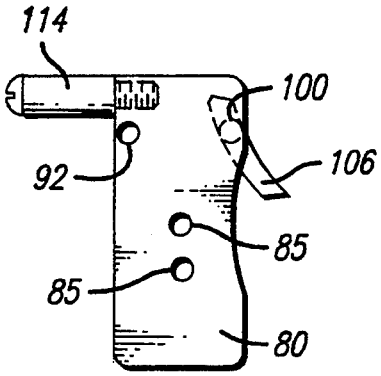
FIG. 20 *a, b,* and *c* are a side, top and front view of the rack gear housing of FIG. 17.
Figure 20B:
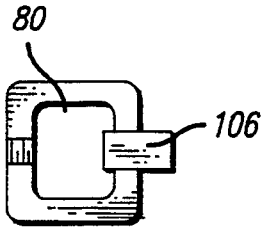
Figure 20C:
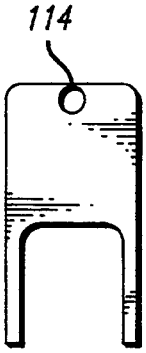
Figure 21A:
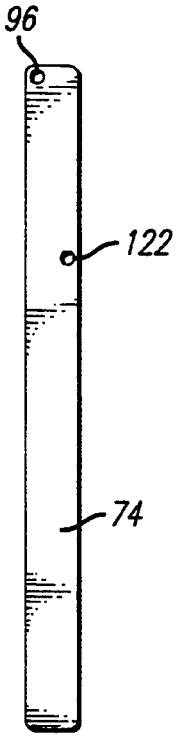
FIG. 21 *a* & *b* are front and perspective views of one of the handles of FIG. 17
Figure 21B:
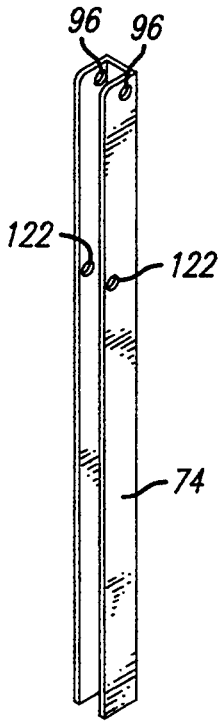

Housing 78, 80 has threaded holes 83, 85, as seen in FIG. 16*a* and 20*a*, for attachment to handle 72, 76 through handle holes 86, 88. Housing 78, 80 also has threaded hole 90, 92 for axle screws to pivotally attach to handle 70, 74 through axle holes 94, 96, shown in FIG. 15, and 21, in handle 70, 74.

Hole 98, 100 as shown in FIG. 16*a* and 20*a* is to accommodate roll pin 102 for attachment of lever gear stop 104,106.

Figure 13:
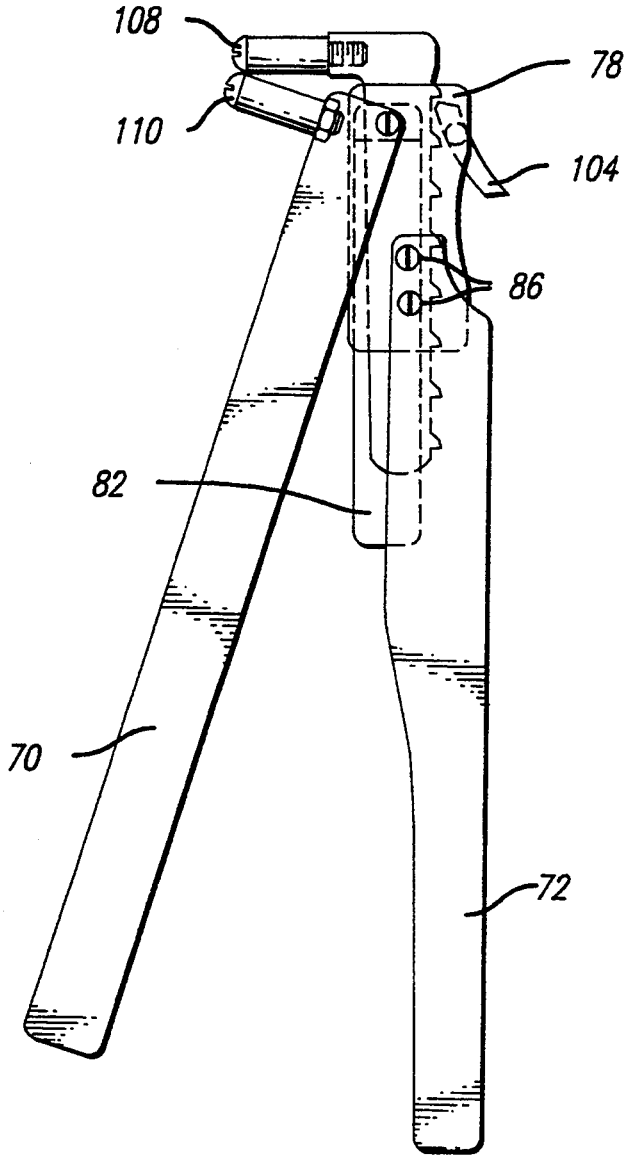
FIG. 13 is a front view of another embodiment.

In FIG. 13 a roller 108 is attached at the top of rack gear 82 and a roller 110 is attached at the top of handle 70. In FIG. 17 a roller 112 is attached at the top of rack gear 84 and a roller 114 is attached to the top of housing 80.

Thus, the rollers 108–110 and 112–114 are adjustable by allowing adjustment of handle 72–76 through rack gear 82–84.

Figure 14A:
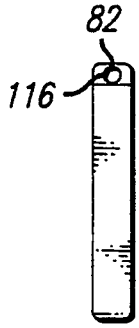
FIG. 14 *a,b* & *c* are front, back and side views respectively of the rack gear of embodiment 13.
Figure 14B:
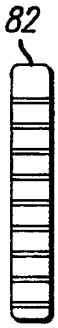
Figure 14C:
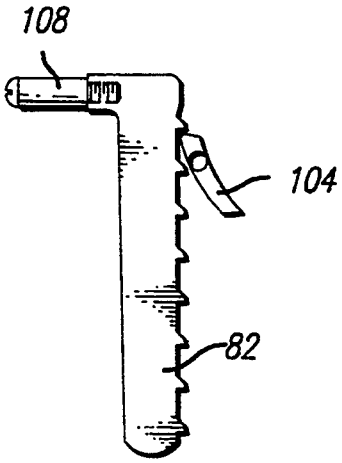
Figure 15A:
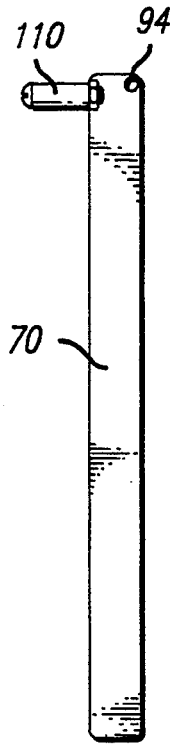
FIG. 15 *a* & *b* are front and perspective views of one of the handles of FIG. 13.
Figure 15B:
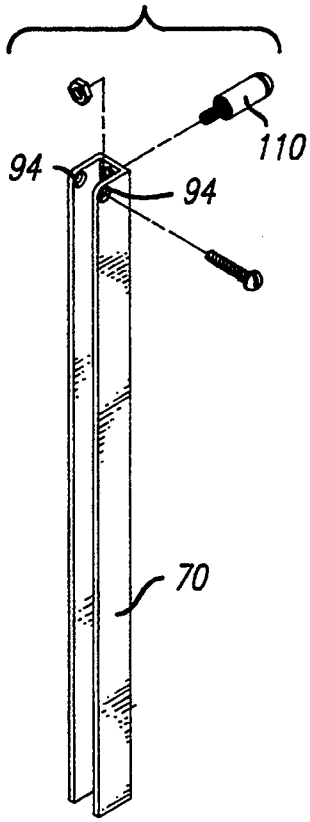

FIG. 14*a* is a front view of rack gear 82 showing threaded roller hole 116.

FIG. 18*a* is a front view of rack gear 84 showing threaded roller hole 118.

In FIG. 13 when the handles are squeezed together, roller 110 is hinged downward away from roller 108 creating an opposing motion between said rollers.

In FIG. 17 a lever 120 is pivotally attached to handle 74 at holes 122. When the handles 74–76 are squeezed together, lever 120 acts with upward force against rack gear 84 pushing roller 112 upward and away from roller 114. Rear lever gear stop 106 acts with a ratchet effect to keep roller 112 extended to the desired length for the pipe to be deburred. To make the tool operable with one hand, lever 120 has a rounded tip to allow automatic disengagement from rack gears 124 when handle 74 is completely compressed against handle 76. The rear lever 106 is pushed in at the bottom with the thumb to disengage it from rear rack gears 126, allowing the top roller 112 to be readjusted if desired.

Having thus described the invention, I claim:

1. A hand operated tool used to deburr the inside circumference of a pipe comprising a plurality of rollers, each roller rotatably attached near one end of each of a pair of lever arms, means joining said lever arms together at a pivotal axis, in which a plurality of rollers are rotatably attached near the end of each lever arm.

2. A hand operated tool used to deburr the inside circumference of a pipe comprising a plurality of rollers, each roller rotatably attached near a first end of each of a pair of lever arms, means joining said lever arms together at a pivotal axis located between first and second ends of each lever arm whereby actuation of second ends of the lever arms toward one another moves at least two of said rollers apart from one another in which one roller is attached to one lever arm and a plurality of rollers are attached to the other lever arm.

3. A hand operated tool used to deburr the inside circumference of a pipe comprising a plurality of rollers, each roller rotatably attached near one end of each of a pair of lever arms, means joining said lever arms together at a pivotal axis, comprising means to adjust the length of one of the lever arms.

4. The device of claim 3 in which said means comprises a rack gear attached to the end of said lever arm.

5. The device of claim 4 in which the roller is rotatably attached to the end of said rack gear.

6. The device of claim 3 in which said means comprises a rack gear contained within a rack gear housing, said housing being fixedly attached to the end of one of the lever handles.

7. The device of claim 6 in which one roller is rotatably attached near the end of the rack gear and one roller is rotatably attached near the end of said housing.

* * * * *